US005401121A

United States Patent [19]

Nakashima et al.

[11] Patent Number: 5,401,121

[45] Date of Patent: Mar. 28, 1995

[54] ALL-AROUND TYPE REINFORCING AND CONSOLIDATING METHOD IN THE GROUND AND APPARATUS THEREOF

[75] Inventors: Shiro Nakashima, 3-1-5, Stakedai, Suita-Shi, Osaka-Fu; Wataru Nakanishi, Machida, both of Japan

[73] Assignees: N.I.T. Co., Ltd., Tokyo; Shiro Nakashima, Osaka, both of Japan

[21] Appl. No.: 103,383

[22] Filed: Aug. 9, 1993

[30] Foreign Application Priority Data

Jun. 22, 1993 [JP] Japan ..... 5-174723

[51] Int. Cl.[6] ..... E02D 3/12

[52] U.S. Cl. ..... 405/269; 405/233; 405/240; 405/303

[58] Field of Search ..... 405/269, 240, 241, 232, 405/233, 266, 263, 267, 237

[56] References Cited

U.S. PATENT DOCUMENTS

| | | | |
|---|---|---|---|
| 3,707,848 | 1/1973 | Chelminski | 405/240 X |
| 4,253,781 | 3/1981 | Fischer et al. | 405/269 X |
| 4,433,943 | 2/1984 | Chen | 405/241 |
| 4,449,856 | 5/1984 | Tokoro et al. | 405/269 |
| 4,786,212 | 11/1988 | Bauer et al. | 405/241 X |
| 4,971,480 | 11/1990 | Nakanishi | 405/263 X |
| 5,141,366 | 8/1992 | Ishida et al. | 405/266 X |
| 5,160,220 | 11/1992 | Yoshida et al. | 405/240 X |
| 5,197,828 | 3/1993 | Nakanishi et al. | 405/269 |

FOREIGN PATENT DOCUMENTS

| | | | |
|---|---|---|---|
| 0062212 | 4/1983 | Japan | 405/269 |
| 4089913 | 3/1992 | Japan | 405/269 |

*Primary Examiner*—Dennis L. Taylor

*Attorney, Agent, or Firm*—Shlesinger, Arkwright & Garvey

[57] ABSTRACT

All-around type ground reinforcing and consolidating method comprises an excavating step for forming an excavated space in a predetermined area in the ground by using a dual excavating rod composed of an outer excavating member and an inner excavating member which is movably arranged in the outer excavating member; a retracting step for retracting the inner excavating member from the outer excavating member, whereby the outer excavating member is remained in the excavated space; a check step for checking the excavated space by inserting a light member containing a battery into the excavated space; an inserting-step for inserting an injection rod into the outer excavating member; a pressure adjusting step for adjusting the pressure in the excavated space; and an injecting step for injecting a hardening material into the excavated space with retracting the outer excavating member and the injection rod, whereby the predetermined area can be consolidated. An apparatus adapted for the above method comprises a dual excavating rod, an injection rod, and a drive unit for selectively driving the dual excavating rod and the injection rod linearly and revolvingly. The dual excavating rod includes and outer excavating member and an inner excavating member which is movably inserted in the outer excavating member.

21 Claims, 11 Drawing Sheets

ALL-AROUND TYPE REINFORCING AND CONSOLIDATING METHOD IN THE GROUND AND APPARATUS THEREOF

BACKGROUND OF THE INVENTION

1. Field of the Invention

The present invention generally relates to a method for reinforcing, consolidating and stabilizing a predetermined area in the ground to improve sandy soil and soft ground in building site, underground construction scene, sea side and mountain zone. More particularly, the present invention relates to an improvement in a method of all-around type reinforcing and consolidating work which is adapted for any angle works such as vertical, slant and horizontal works. Further, the present invention relates to an apparatus for performing the above described method.

2. Description of the Prior Art

Conventionally, various methods for reinforcing and consolidating the soil or soft ground have been developed and used to make underpinnings and hard foundations in a building site and other constructing sites in mountains and sea sides. Especially in urban area, it has been quickly required to develop new systems for the construction works in an extremely deep underground. For instance, an underground train, an underground high way, an underground commercial street, an underground parking site, etc. have been recently proposed as a practical plan to make efficient use of highly closed built area in large cities. However, most large cities are constructed on the alluvial soft ground which requires an effective reinforcing, consolidating and stabilizing system capable of satisfying complicated construction works in the extremely deep underground.

On the other hand, a commonly used method of various ground-consolidating works includes at least one of injecting systems using pressurized water, air, and hardening material. As an example, CCP-Method; trade name by Wataru Nakanishi, 1970, has been broadly known. Further improved systems of CCP-Method have been proposed and employed in various scenes. Such improved systems are modifications of the above CCP-Method varied in the pressure and rate of injection, and combination with pressurized air. Most of these improved systems are intended to enlarge the diameter of consolidated area in ground.

However, most of such conventional methods are designed for mainly vertical work with increment of injection pressure, injection rate and jetted air. In the case of works in extremely deep underground or horizontal direction, the injected water and air, and resulted slurry make the pressure in the ground become high because the injected water and air, and the slurry can not be smoothly discharged from the working space. Therefore such conventional methods can not be directly used for all-around conditions Such as the works in extremely deep underground or horizontal direction.

In detail, according to an experimental example in which one conventional method was used for a horizontal work and a slant work, discharging phenomenon of the resulted slurry from the working area through opening space around the working device was stopped at about four minutes after starting. Then the ground surface of working position was slightly rised, and as a position was slightly raised, and as a few minutes passed, the discharged slime was effused out of the ground surface apart from the working position. This resulted in undersirable irregular consolidation owing to the following reason.

The slurry to be discharged from the working area can not be smoothly discharged while the pressurized water, hardening material, air and so on are continuously injected into the working area. Further, since the pressurized air is mixed with the slurry, the air in the working area can not be discharged in the horizontal direction and a tendency to move upwardly occurs. Thus the pressurized air is remained in the working space. The lingering air causes the consolidation to be irregular and the slime and slurry to effuse.

On the other hand, the ground reinforcing and consolidating method includes an excavating step prior to the injection step of the pressurized hardening material and air, and most of the conventional excavating devices used in the excavating step are not provided with any protectors or guards. Accordingly the body and bit of the excavating device are often damaged in the excavated cavity formed in the deep underground. Further the excavating device and the injecting device must be combined in a single rod-shape body so that the injecting device can not be provided with an additional mechanism such as a pressure sensor.

In order to overcome these defects of the conventional methods, the applicant of this invention has already proposed, as Japanese Patent Application No.3-288248/1991, an improved method of all-around type reinforcing and consolidating work which is adapted for any angle works such as vertical, slant and horizontal works especially effective in the extremely deep underground. This all-around type working method is called MJS (Metro Jet System); the trade name registered by the applicant. The present invention belongs to this MJS type working method. Of course, this MJS type working mehod can be performed an improved all-around type reinforcing and consolidating apparatus.

BRIEF SUMMARY OF INVENTION

It is therefore an object of the present invention to provide an all-around ground reinforcing and consolidating method which can detect and adjust the pressure in the working space to effectively reinforce and consolidate the predetermined area in the deep underground.

Another object of the present invention is to provide an all-around ground reinforcing and consolidating method which can be applied to any type of ground materials; i.e., hard ground, in addition to soft ground.

A further object of the present invention is to provide an all-around ground reinforcing and consolidating method which can safely and certainly perform an excavating work in any directions from the ground surface to an predetermined area in the ground, and then form a uniform consolidated area with a large diameter by dischargeng the lingering air and slime from the predetermined area to adjust the pressure in the excavated space and maintain it within a predetermined range.

A still further object of the present invention is to provide an apparatus to perform the above method.

A still further object of the present invention is to provide an apparatus which can smoothly execute an excavating work and a consolidating work with keeping the apparatus per se free from damaging and choking with mud and stones.

To accomplish the above objects, a ground reinforcing and consolidating method according to the present invention comprises an excavating step for excavating a predetermined area in the ground by using a dual excavating rod composed of an outer excavating member and an inner excavating member which is movably arranged in the outer excavating member; a retracting step for retracting the inner excavating member from the outer excavating member, whereby the outer excavating member is remained in the excavated space; a check step for checking the excavated space by inserting a light member containing a battery into the excavated space; an inserting step for inserting an injection rod into the outer excavating member; a pressure adjusting step for adjusting the pressure in the excavated space; and an injecting step for injecting a hardening material into the excavated space with retracting the outer excavating member and the injection rod, whereby the predetermined area can be consolidated.

An apparatus adapted for the above method according to the present invention comprises a dual excavating rod, an injection rod, and a drive unit for selectively driving the dual excavating rod and the injection rod linearly and revolvingly. The dual excavating rod includes an outer excavating member whose top end is provided with a bit, and an inner excavating member whose top end is provided with a bit. The inner excavating member is slidably and rotatably arranged in the outer excavating member. The injection rod includes a pressure sensor for detecting the pressure in the excavated space, a pressure adjustable member elastically expandable for adjusting the pressure in the excavated space, a discharging opening for discharging the slime and mud from the excavated space, and at least one of injection nozzles for injecting a hardening material, air and/or water.

The outer excavating member and the inner excavating member are revolved in the counter direction with each other so that their bits cooperatively act as an effective excavating device. The pressure in the excavated space is always checked by the pressure sensor set on the injection nozzle and can be adjusted by controlling the expansion degree of the pressure adjusting member, the injection pressure of the hardening material and pressurized air, and the opening degree of the discharging opening to discharge the slime from the excavated space.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE PREFERRED EMBODIMENT

One preferred embodiment of the present invention will be described in detail with reference to the accompanying drawings.

Figure 1:
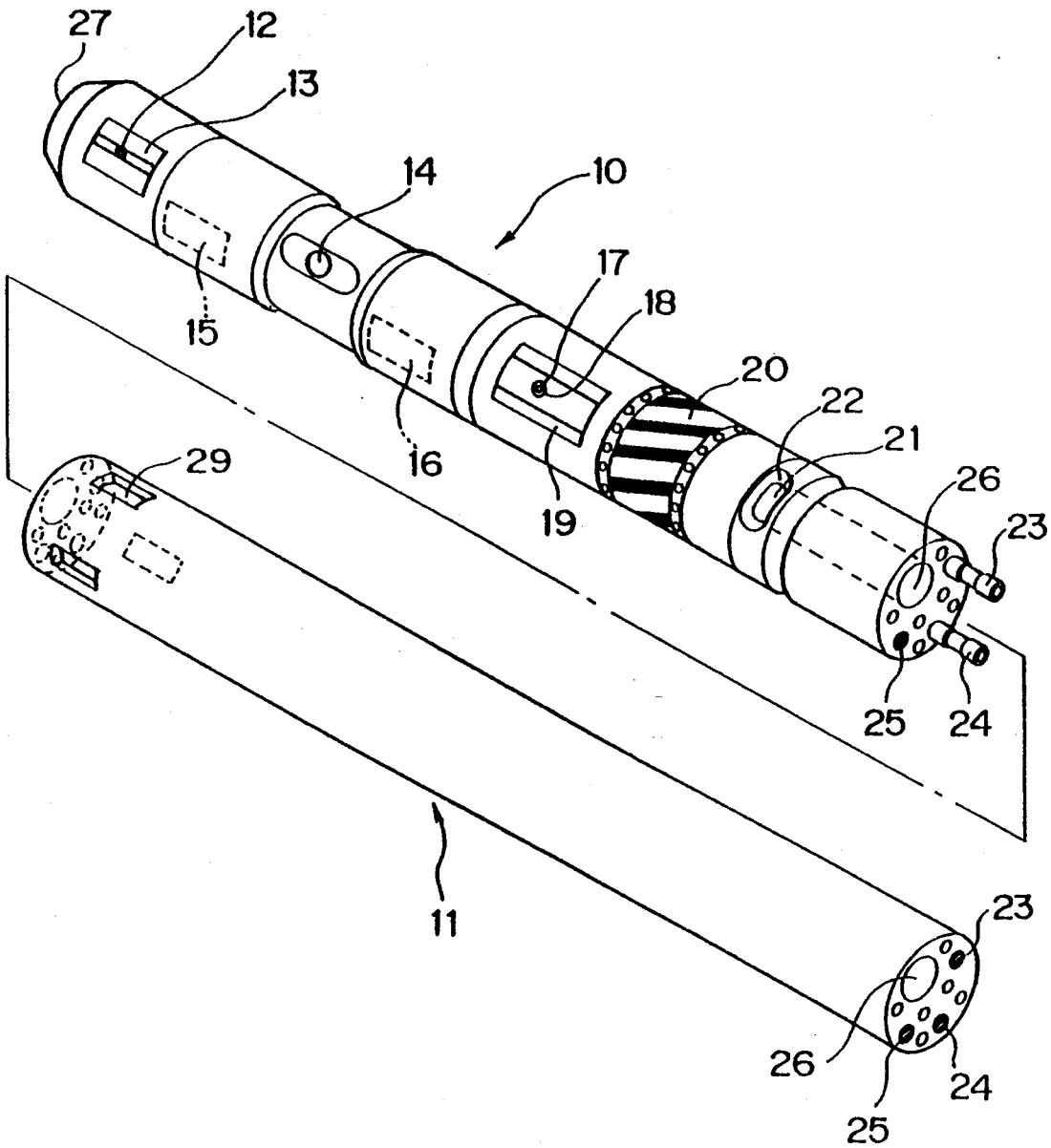
FIG. 1 is a schematic perspective illustration showing an injection rod of a ground reinforcing and consolidating apparatus according to one embodiment of the present invention.
Figure 3:
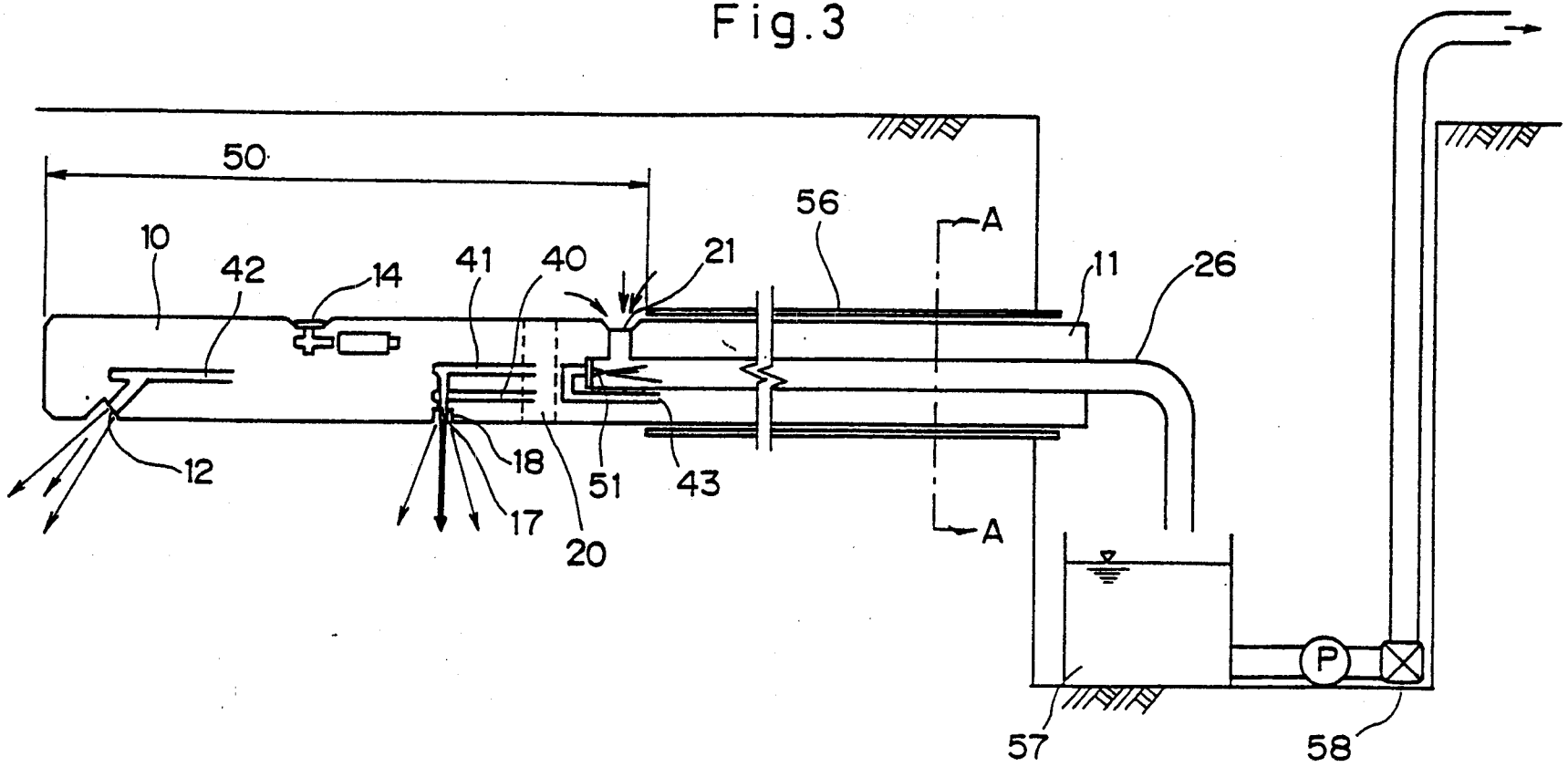
FIG. 3 is a schematic illustration showing one example of a total working system to perform the ground reinforcing and consolidating method according to the present invention.

Referring to FIG. 1, there is shown an injection rod 10 and a connection rod 11 as a typical embodiment. The injection rod 10 mainly includes a first nozzle 12 for injecting a hardening-control agent, a pressure sensor 14, a second nozzle 17 for injecting a hardening material, a third nozzle 18 for injecting highly pressurized air or water, an elastic member 20 and an opening 21 for discharging slime. The second nozzle 17 is surrounded with the third nozzle 18. These means are arranged from the front end of the injection rod 10 to the rear end; i.e., from the left to the right in FIG. 1. This arranged section is referred to a monitor section 50 as shown in FIG. 3.

The first nozzle 12, the second and third nozzle 17, 18, are further provided with cover members 13 and 19, respectively to selectively expose and close the nozzles. The opening 21 is also provided with a cover member having the same function as the cover members 13 and 19, but it is not shown in FIG. 1.

Further, the injection rod 10 includes battery boxes 15 and 16 for actuating the cover members. One of the battery boxes may include a transmitter of the pressure sensor 14 when a radio communication system is employed to transmit the data detected by the pressure sensor 14 to a control unit set on a remote place, or on the ground surface. On the other hand, the data detected by the pressure sensor 14 may be informed to the control unit through a cable installed in the rods 10 and 11, will be described later.

Figure 4:
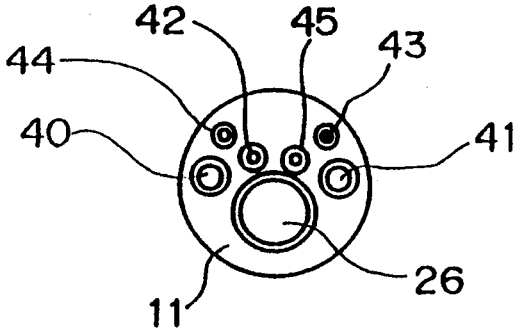
FIG. 4 is a sectional view taken along line A—A in FIG. 3, showing a structure of an injection rod according to the present invention.

The connection rod 11 includes a plurality of through holes as shown in FIG. 1 and FIG. 4. Desired number of the rods 11 are extendingly connected until the injection rod 10 reaches to the aimed area. To firmly fasten the connection between the injection rod 10 and the connection rod 11 (between the preceding and succeeding connection rods 11), any conventional connection means may be applied. In this embodiment, three connection bolts are used for each connection (two bolts 23' and 24' are only shown in FIG. 1). The rear end of the injection rod 10 are formed with three connection holes 23, 24 and 25 in which the connection bolts are engaged. On the other hand, the front end of the connection rod 11 is formed with three connection holes corresponding to the three connection holes formed in the injection rod 10, and three connection slots 29 through which the connection bolts are fastened to the connection rod 11.

In working scene, the injection rod 10 connected to at least one of the connection rod 11 is inserted into an outer excavating member after excavating work, and advanced toward the aimed position. Then the outer excavating member is retracted to expose the monitor, section 50 of the injection rod 10. In this state, the monitor section 50 starts the first injection for injecting hardening material under a high pressure, for example about 400 kg/cm$^2$, through the second nozzle 17 as a core nozzle of the third nozzle 18 which injects air or water. The injection pressure is not limited to this value.

As described above, the injection rod 10 is provided with the injection nozzles, the discharging opening, the pressure sensor, and the elastic member as shown in FIG. 3. Although the layout of these means may be somewhat varied, this layout is required to perform the method of the present invention.

In reinforcing and consolidating step, the injection rod 10 is gradually retracted rearwardly from the excavated space with keeping the injection of hardening material from the second nozzle 17. As the high pressurized hardening material is injected, the pressure in the excavated space is gradually increased and thus increased pressure becomes remarkably high or releases through the gap between the injection rod 10 and the excavated wall, and the pressure in the excavated space in suddenly lowered. In order to keep the pressure in the excavated space at a constant level, the pressure sensor 14 always monitors the pressure in the excavated space and the injection pressure and/or amount of the hardening material from the second nozzle 17, and the pressure and/or amount of the air or water from the third nozzle 18 are controlled in response to the detected data from the pressure sensor 14. Further, the opening degree of the discharging opening 21 and the pressure of the elastic member 20 are also adjusted in combination with the injection pressure so as to spread and store the hardening material uniformly in the excavated space and discharge the slime smoothly from the excavated space. Since the slime is generated above the stored hardening material, the discharging opening 21 has to be positioned in the upper or rear place rather than the second nozzle 17. The pressure sensor 14 has to be positioned in the front or lower place rather than the second nozzle 17 to detect the actual pressure in the excavated space which is varied by the injection pressure of the hardening material.

The elastic member 20 between the second nozzle 17 and the discharging opening 21 is expanded by pressurized air fed through an air feeding pipe 45 installed in the connection rod 11. Thud expanded elastic member 20 closes the gap between the injection rod 10 and the excavated wall to discharge only the excess slime. The expanded elastic member 20 also prevents the hardening material from releasing out of the excavated .space. Further, the pressure in the excavated space can be maintained at a constant level owing to the expanded elastic member 20.

The constitution among the injection nozzle 17 of the hardening material, the elastic member 20 and the discharging opening 21 is particularly effective for the reinforcing and consolidating work in the horizontal and slant directions. In the vertical direction, the elastic member 20 may be positioned rearwardly than the discharging opening 21. The applicant confirmed the pressure control effect of the elastic member 20 by some experimental tests.

The hardening control agent is injected by the first nozzle 12 a few seconds after the injection of a predetermined amount of the hardening material to apply the hardening control agent to the hardening material. In normal working method, the hardening control agent is injected forwardly from the first nozzle 12 set at the front section near the front end 27 of the injection rod 10 which is gradually turned and moved rearwardly as shown in FIG. 3, so that the hardening material is hardened after the injection rod 10 is removed from the excavated space. In a particular geological feature, the hardening material and the hardening control agent may be simultaneously injected.

As a modified example of the above described embodiment, an excavating bit may be assembled on the front end 27 of the injection rod 10. This modified configuration is especially effective in some cases that additional excavating work is required after the dual excavating rod is removed from the excavated space, or both excavating and consolidating works are carried out on the some occasion.

Further the nozzles and the discharging opening may be each provided with a covering member which can be alternatively opened and closed by any well known remote control system. This covering member may prevent the nozzles and the discharging opening from damaging by stones or the like during the excavating work. The covering member for the discharging opening 21 may be also used as an adjusting means for the discharging rate of the slime.

Figure 2:
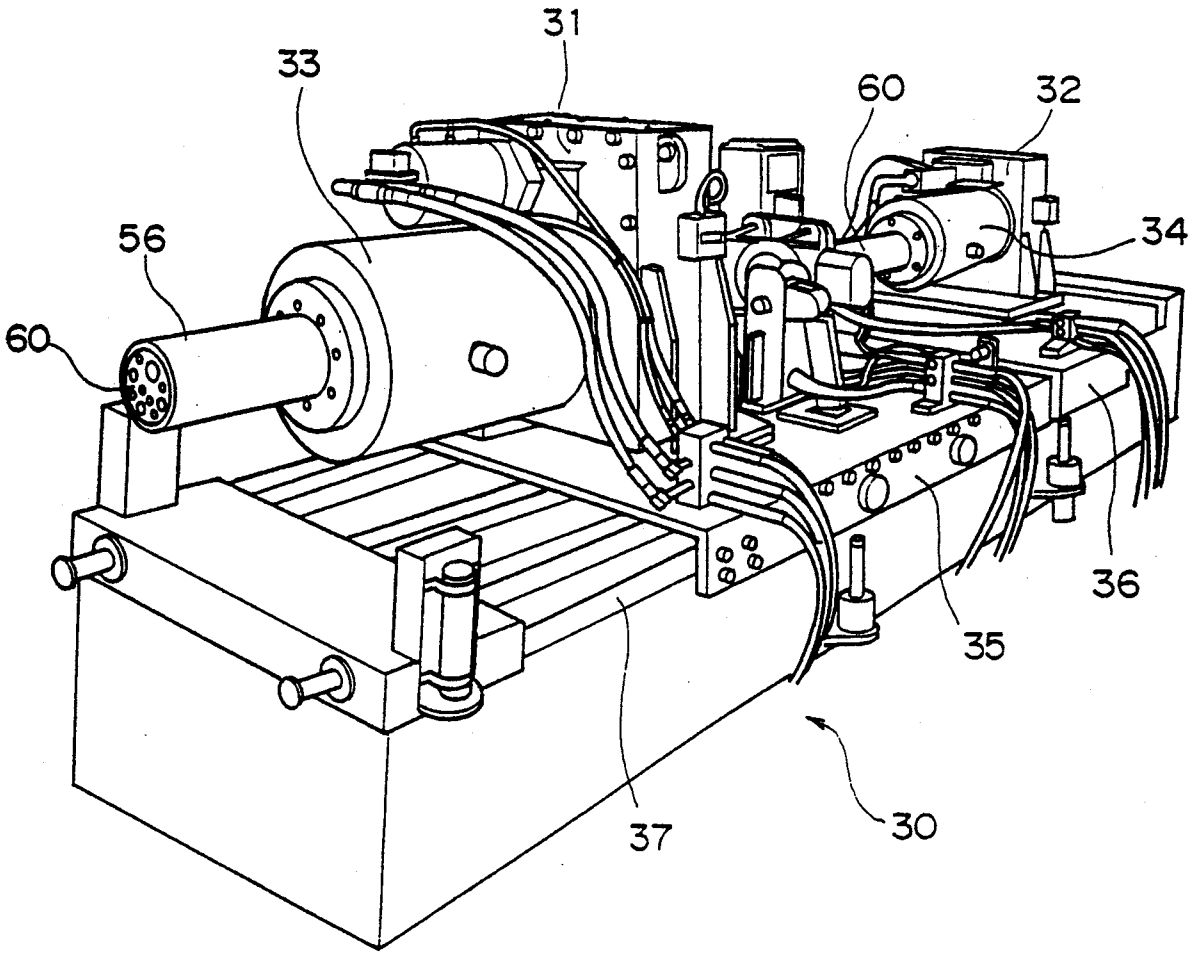
FIG. 2 is a schematic illustration showing a central control device including a drive unit to linearly and revolvingly drive a dual rod, land an injection rod.

Referring to FIG. 2, there is shown an example of control device adapted for the dual excavating rod and the injection rod according to the present invention. This control device includes a base member 30, a first drive unit 31 and a second drive unit 32. These drive units 31 nd 32 are independently mounted on sliding members 35 and 36 capable of sliding on the base member 30 through rails 37 so that they are independently moved linearly. The first drive unit 31 securely supports the outer excavating member 56 of the dual excavating rod and the second drive unit 32 securely supports the inner excavating member 56 of the dual excavating rod or the injection rod 60. FIG. 2 shows one example wherein the injection rod 60 is supported by the second drive unit 32 and installed in the outer excavating member 56. In other words, the injection rod 60 can be slidably moved through the inner space of the outer excavating member 56. The outer excavating member 56 is rotated by a first motor 33 and the injection rod 60 is rotated by a second motor 34, respectively.

In an excavating work by using the dual excavating rod, the .first and second drive units 31 and 32 are simultaneously moved forwardly on the rails 37 to the aimed position. After this excavating work, the second drive unit 32 is only moved backwardly to retract the inner excavating member from the outer excavating member 56. Then the inner excavating member is replaced by the injection rod 60 and the second drive unit 32 is again moved forwardly to reach the injection rod 60 to the excavated space. The operation of the preferred embodiment will be described in detail later with reference to FIGS. 11A–D.

The dimension of this control device may be varied in response to working condition.

Referring to FIG. 3, a schematic illustration of the injection rod 10 is shown to explain the injection work and the structure of the injection rod 10. The outer excavating member 56 is moved rearwardly so that the monitor section 50 of the injection rod 10 is exposed. Since the length of the monitor section 50 is previously known, the retracted length of the outer excavating member 56 indicates whether the monitor section 50 is exposed or not.

Under these conditions, the hardening material is injected from the second nozzle 17 and the pressurized air or water is simultaneously injected from the third nozzle 18 which surrounds the second nozzle 17 so that the hardening material is surrounded by the pressurized ari or water. The pressure sensor 14 detects the pressure in the excavated space, and transmits the detected data to the control device via the transmitter included in the rod 10, not shown. The hardening control agent is injected from the first nozzle 12. On the same occasion, a pressurized air ot water is fed through a pipe 43 and jetted from a jet nozzle 51 to generated sucking force. The slime is forcibly sucked by the discharging opening 21 owing to the sucking force. The sucked slime is forcibly discharged out of the excavated space through a larger pipe 26. The discharged alime is temporarily stored in a slime pool 57. Additionally, the slime is fed to any well known waste water treating system located on the ground surface by a pump while a flow meter 58 measures the flow rate of the slime.

The pressurized air or water from the third nozzle 18 and the hardening material from the second nozzle 17 are not always injected on the same occasion. They may be independetly injected as required because the nozzles 17 and 18 belong to different feeding systems, respectively.

As described before, the elastic member 20 is useful for controlling the pressure in the excavated space.

Referring to FIG. 4, there is shown a cross-sectional view of the connection rod 11, which is taken along the line A—A in FIG. 3. The connection rod 11 includes a plurality of pipes such as the larger pipes 26 for discharging the slime from the excavated space, the smaller pipe 43 for feeding the high pressurized air or water to the jet nozzle 51 in the discharging opening 21, a first feeding pipe 42 for feeding the hardening control agent to the first nozzle 12, a second feeding pipe 41 for feeding the hardening material to the second nozzle 17, a third feeding pipe 40 for feeding the high pressurized air or water to the third nozzle 18, a cable pipe 44 for a cable connected to the pressure sensor 14, and an air pipe 45 for feeding pipe 40 for feeding the high pressurized air or water to the third nozzle 18, a cable pipe 44 for a cable connected to the pressure sensor 14, and an air pipe 45 for feeding pneumatic pressure to the elastic member 20.

Figure 5:
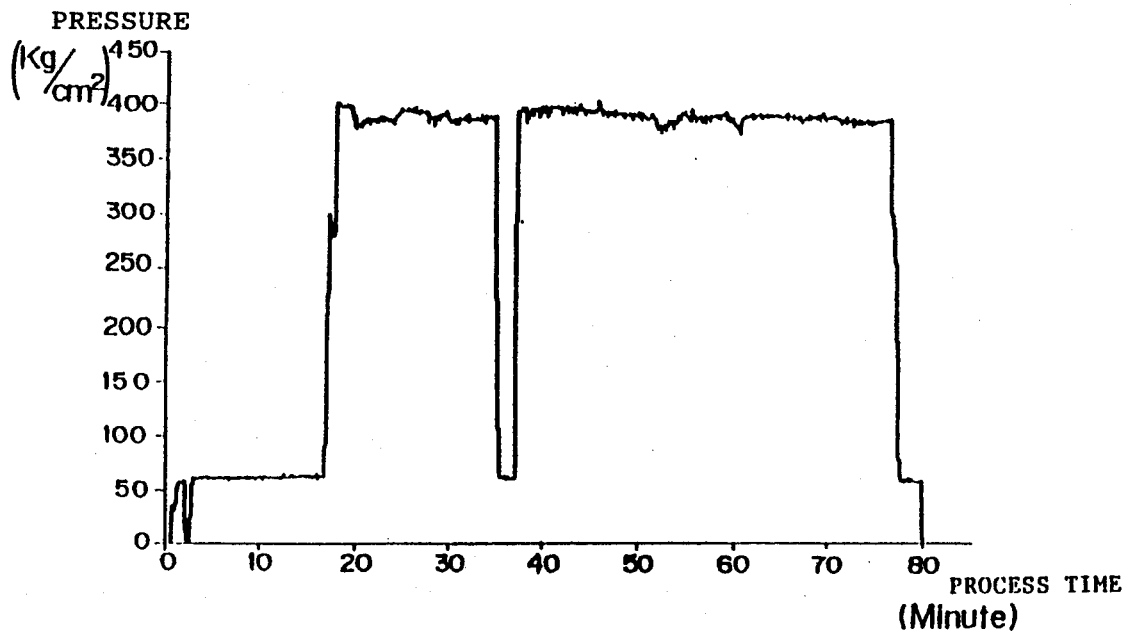
FIG. 5 is a graphic diagram representing a relation between injection pressure and process time resulted by a high pressure injection-pump associated with the apparatus according to the present invention.

FIG. 5 shows a first experimental data representing the relation between the injection pressure of the hardening material injected from the second nozzle 17 and the process time. At about 15 minutes after starting the injection, the injection pressure reaches to about 400 $kg/cm^2$ and can be maintained at a constant value while running conditions of the pressure pump are not varied.

Figure 6:
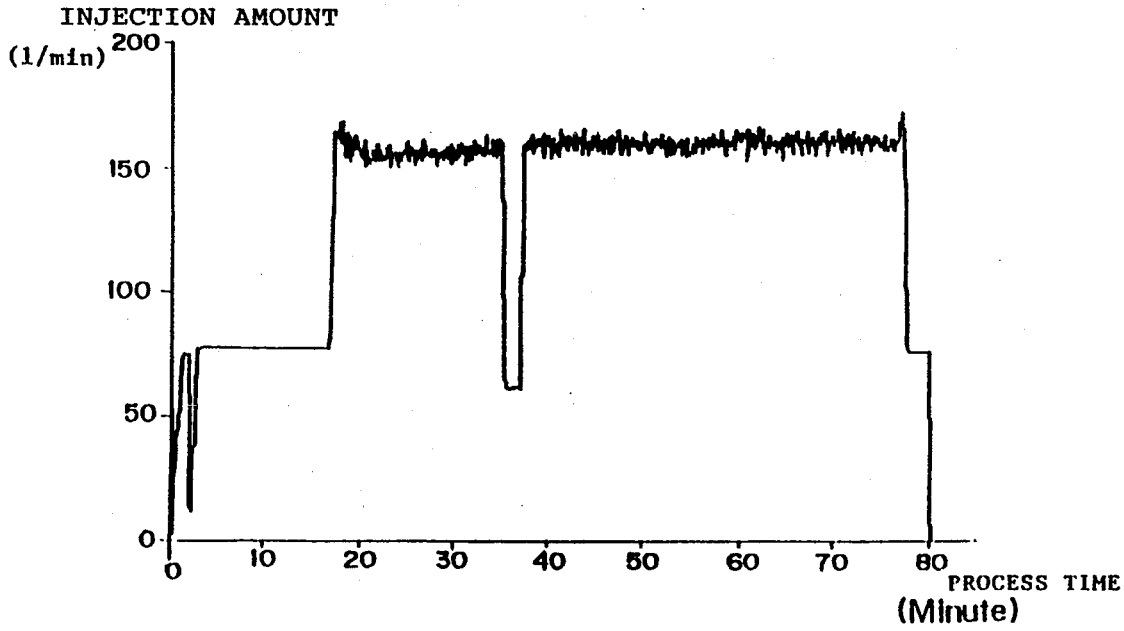
FIG. 6 is a graphic diagram representing a relation between injection amount and process time resulted by a high pressure injection pump associated with the apparatus according to the present invention.

FIG. 6 shows a second experimental data representing the relation between the injection amount per minute and the process time. Since this data is based on the same experiment as FIG. 5, this data indicates essentially the same result as the above. At about 15 minutes after starting the injection, the injection amount reaches to about 150 1/min by the injection pressure of about 400 $kg/cm^2$.

Figure 7:
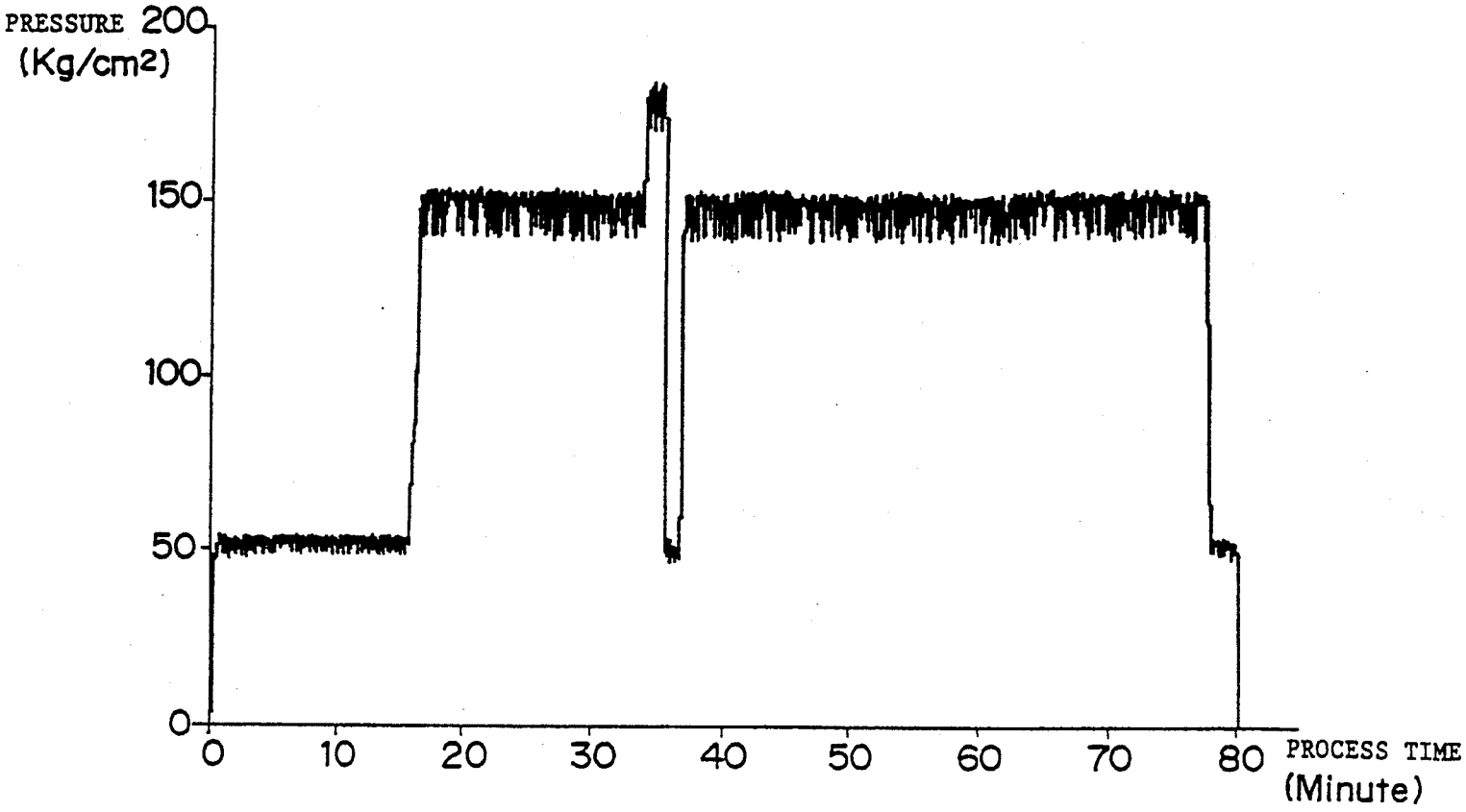
FIG. 7 is a graphic diagram representing a relation between process time and pressure of water or air injected by a discharge pump for discharging slime from the excavated space.

FIG. 7 .shows a third experimental data representing the relation between the pressure of water or air jetted from the jet nozzle 51 in the discharging opening 21 and the process time. Under the regular conditions, the pressure is kept at about 150 $kg/cm^2$.

Figure 8:
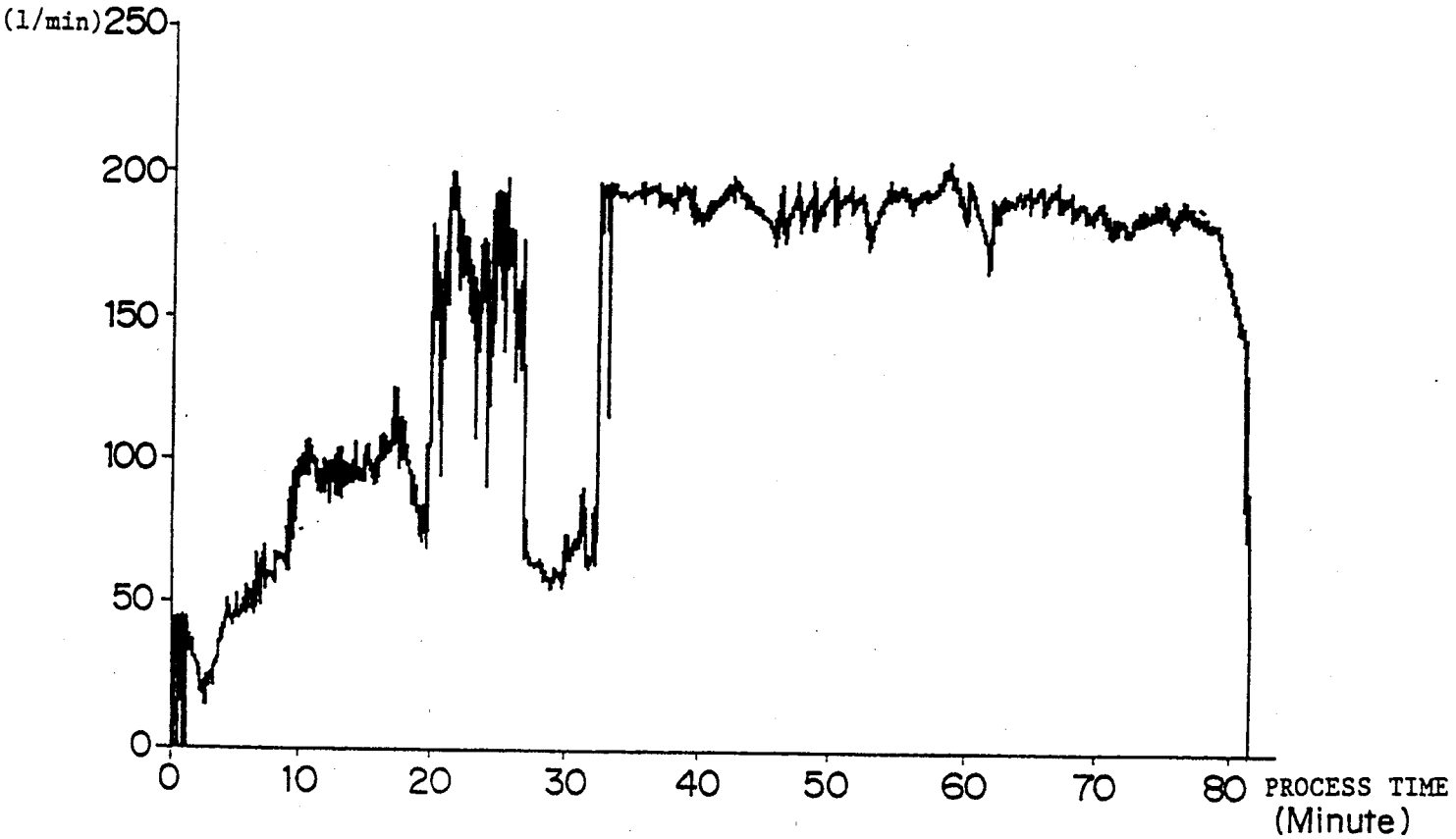
FIG. 8 is a graphic diagram representing discharged amount of slime through the injection rod shown in FIG. 4.

FIG. 8 shows a fourth experimental data representing the relation between the slime amount discharged through the discharging opening 21 per minute and the process time. The discharged slime amount was measured by the flow meter 58. The flow rate of the slime as fluctuated for 30 minutes from start, and after then, kept in a stable state.

Figure 9:
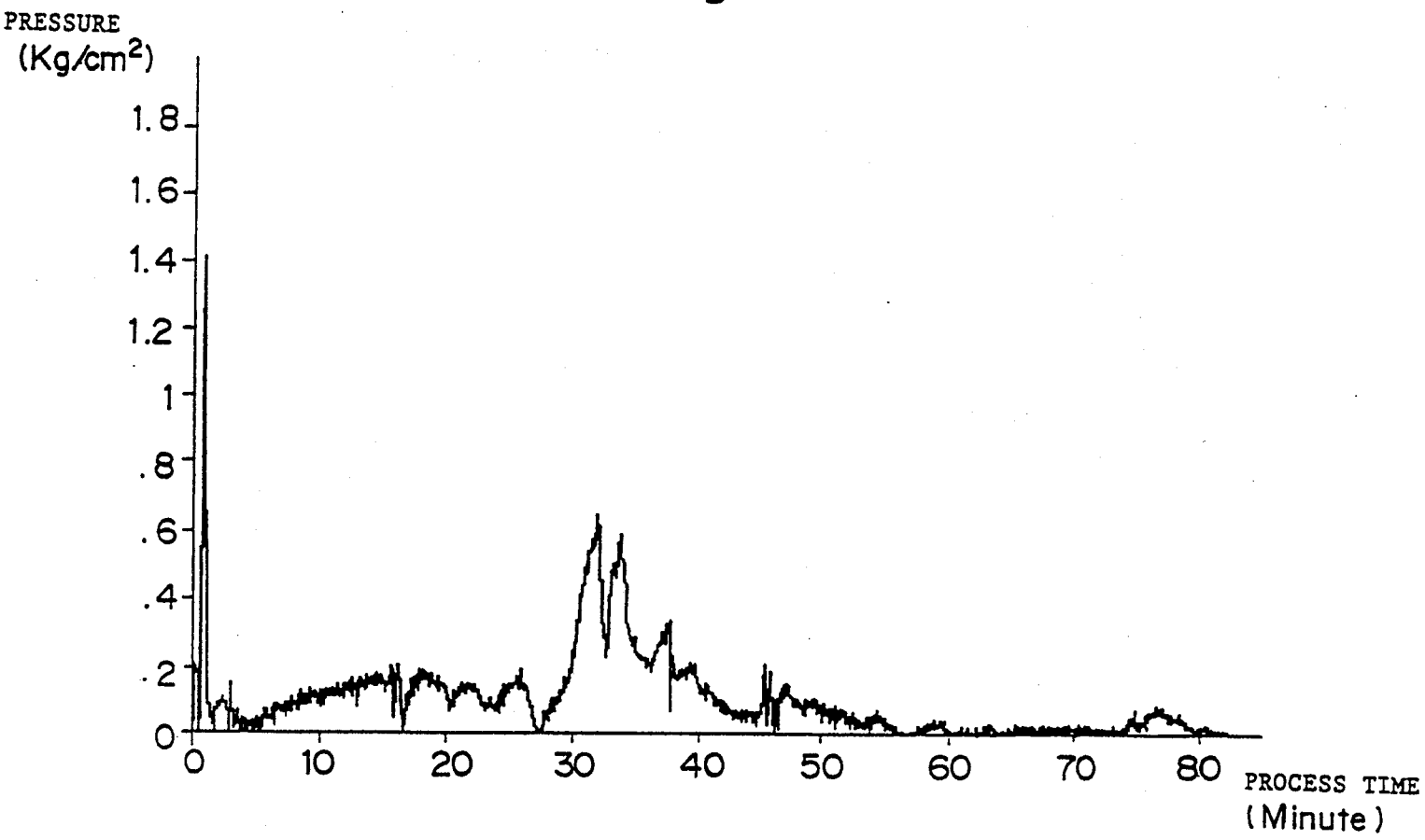
FIG. 9 is a graphic diagram representing a relation between pressure in the excavated space and process time.

FIG. 9 shows a fifth experimental data representing the relation between the pressure in the excavated space and the process time. The pressure was kept at about 0.2 $kg/cm^2$ or less except at about 30 minutes after start when the pressure was suddenly increased. The pressure in the excavated space depends on the discharging performance of the discharging system while the injection pressure and rate are not varied.

FIG. 5 to FIG. 9 are significant experimental data for verifying that the system according to the present invention can maintain the amount for discharging the slime from the excavated space at a constant rate so that the hardening material can be uniformly supplied in a predetermined area.

FIGS. 11A–D show a sequence of typical working steps according to the method of the present invention.

Figure 10:
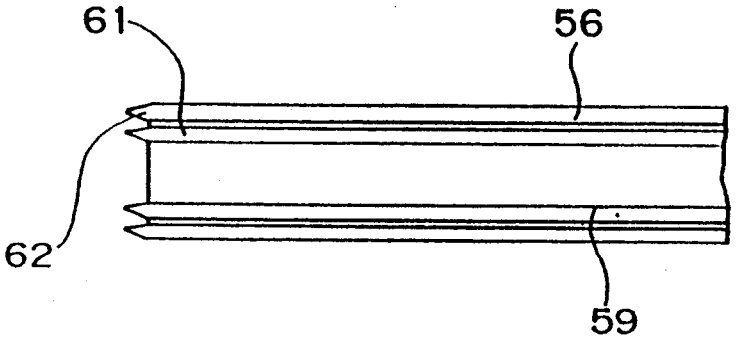
FIG. 10 is a schematically sectional view showing an excavating mode of a dual excavating rod, wherein an inner rod is installed in an outer rod, according to the present invention.
Figure 11A:
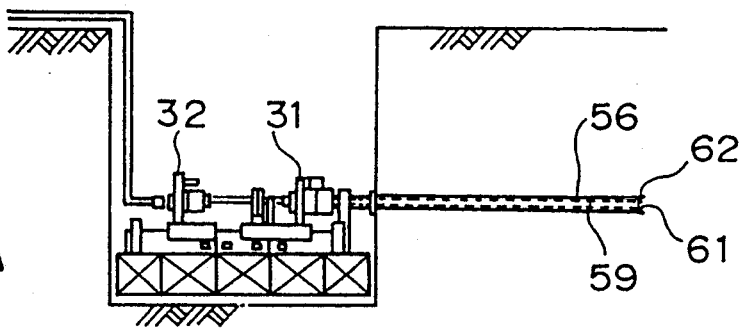
FIGS. 11A–D schematically illustrate the sequence of a typical working process according to the method of the present invention.

As a pre-working operation, the first and second drive units 31 and 32 are set in a working cavity or chamber formed into the ground. Further, the pressure and flow meters are set in the predetermined positions. The first step, shown in FIG. 11A, represents an excavating work that the first drive unit 31 drives the outer excavating member 56 forwardly and the second drive unit 32 also drives the inner excavating member 59 forwardly into the inner space of the outer excavating member 56 as shown in FIG. 10, and then the inner and outer excavating members 56 and 59 are moved forwardly to a predetermined position while inner and outer excavating bits 61 and 62 fixed to the forward ends of the outer and inner excavatin members 56 and 59 are preferably turned in reverse direction with each other. It is needless to say that this turning direction is not only limited to this way, but it depends on soil conditions. Further, since the inner and outer excavating bits 61 and 62 are independently driven by the second and first drive units 32 and 31, their turning speed may be independently varied.

Figure 11B:
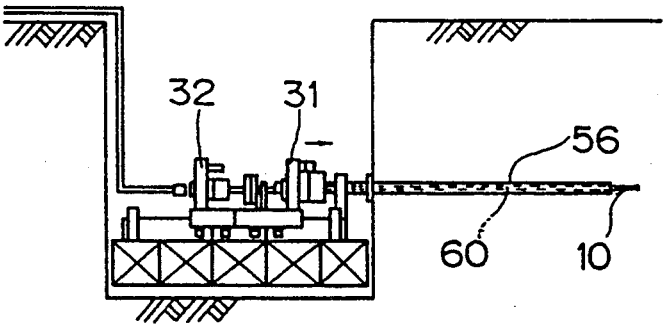

The second step shown in FIG. 11B, represents that the inner excavating member 59 is replaced by a consolidating rod 60 comprised of the injection rod 10 and the connection rods 11 after the excavating work. In detail, the inner excavating member 59 is retracted from the outer excavating member 56 by the second drive unit 32, and the consolidating rod 60 is inserted into the inner space of the outer excavating member 59. Then the outer excavating member 59 is also moved rearwardly to a predetermined length so that the monitor section 50 of the infection rod 10 is only exposed in the excavated space.

Figure 11C:
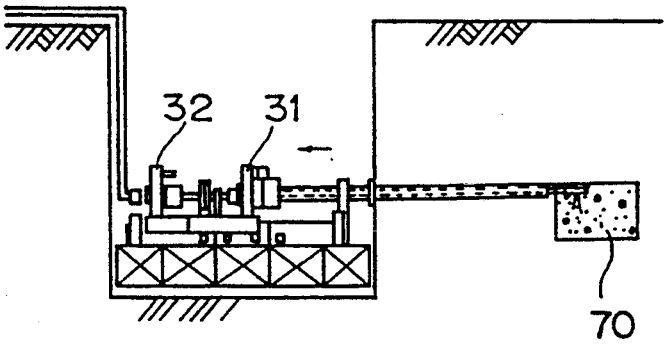

The third step, shown in FIG. 11C, represents a beginning stage of consolidating work that the hardening material is infected from the injection rod 10, and the injection rod 10 and the outer excavating member 56 are gradually retracted in the arrow direction to form consolidated area 70.

Figure 11D:
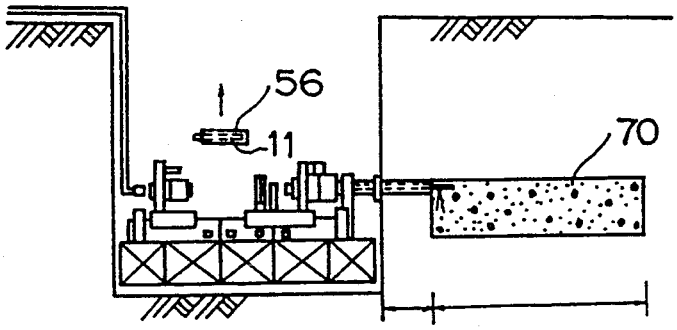

The fourth step shown in FIG. 11D, represents a final stage of consolidating work that the outer excavating member 56 and the connection rod 11 installed in the member 56 are partially removed from the first and second drive units 31 and 32. The hardening material is almost hardened in the predetermined area. In this working example, the injection rod 10 is turned within the angle of 180° so that the cross sectional shape of the consolidated area 70 is a semicircle.

Figure 12:
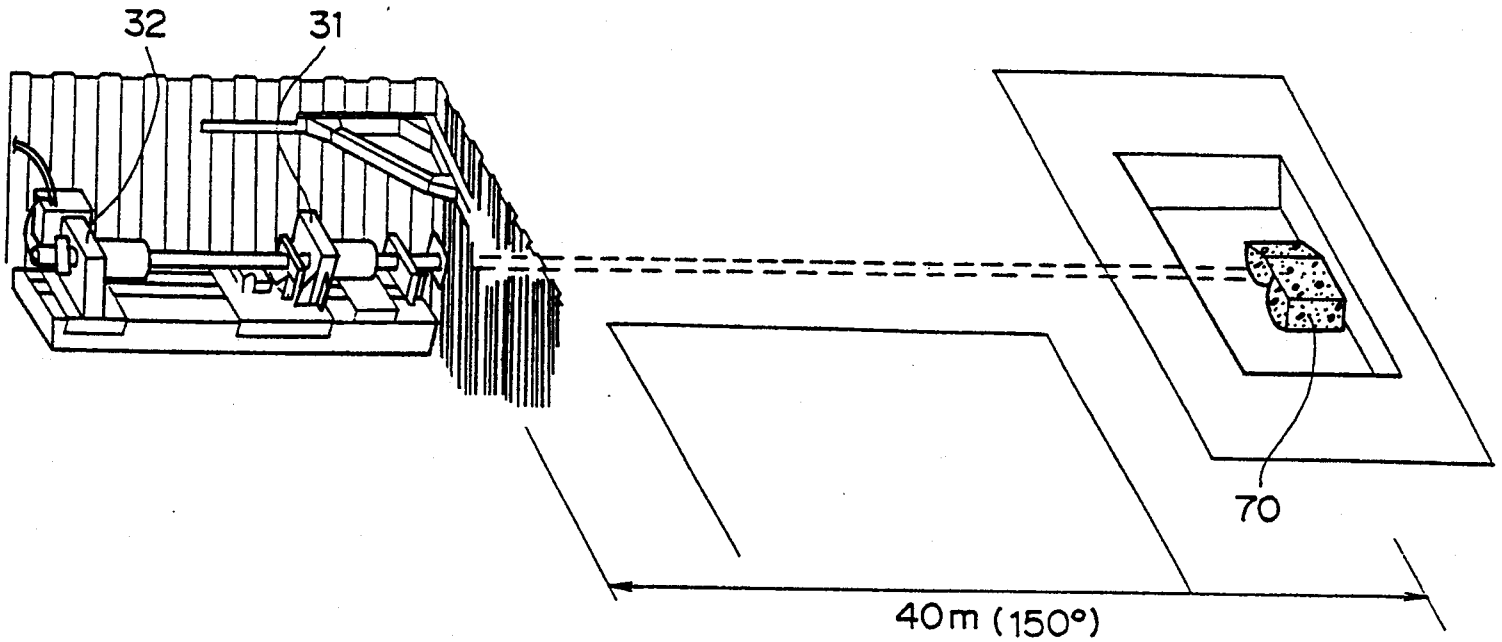
FIG. 12 is a perspective schematic view showing one example of the reinforced and consolidated area formed by the method of the present invention.

FIG. 12 is a perspective view showing one example of the consolidated area formed by the method according to the present invention. In this example, the distance of the working position, under the ground, from the cavity in which the first and second drive units 31 and 32 are set is about 40 m. The hardening material is injected while the injection rod ,10 is turning within the angle of 150° and simultaneously subjected to a swinging motion. This results a consolidated area having dual fun shape cross section. This type method and apparatus can be applied for the excavating and consolidating work up to 100 m distance in any directions.

Figure 13A:
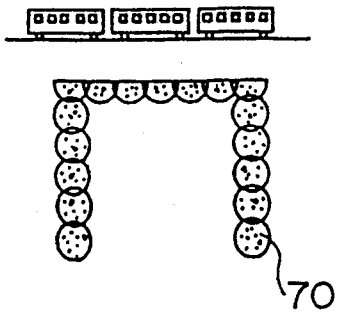
FIGS. 13A–G schematically illustrate various examples of in practical scenes using the method and apparatus in accordance with the present invention.
Figure 13B:
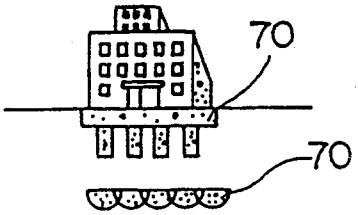
Figure 13C:
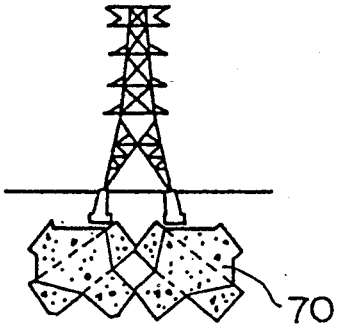
Figure 13D:
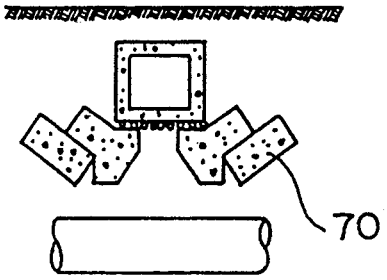
Figure 13E:
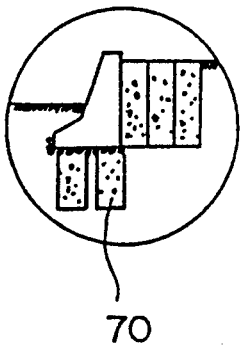
Figure 13F:
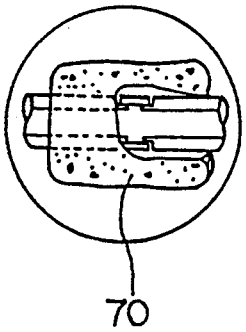
Figure 13G:
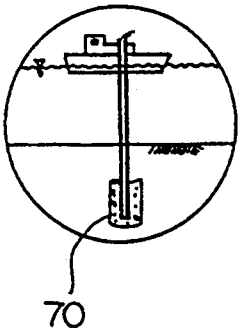

FIGS. 13A–G show various examples in practical scenes using the method and apparatus according to the present invention. FIGS. 13A and 13B show a reinforcing and consolidating work under a railway and a building, respectively, by using the injecting rod turned within the angle of 180° and 360° in the horizontal direction. FIGS. 13C and 13D show another reinforcing and consolidating work in the slanted direction to reinforce the ground under the foundation of antenna tower or cable pylon, and under a conduit, respectively, FIGS. 13E–13G show other reinforcing and consolidating work in the vertical direction to reinforce and protect an existing construction and a jointed section under the ground, and to reinforce and consolidate the ground under river bottom, respectively.

As described in the above explanation, the method and apparatus according to the present invention can precisely control the pressure in the excavated space. If the pressure is higher than the desired range, the hardening material, required, is forcibly discharged in addition to the slime, not required. If lower, the slime, not required, is not smoothly discharged. In both cases, the hardening material is not uniformly spread to the predetermined area. This results in the reinforcement and consolidation of poor durability. On the contrary, the present invention can discharge the slim smoothly so that the hardening material can be uniformly dispersed in any directions and required area.

Further, since the apparatus according to the present invention has a simple and smooth external configuration, the apparatus can reduce the distress caused by the excavating and consolidating works. This results in improvement in usefulness and handling, and simplification of works.

It is further understood by those skilled in the art that the foregoing description is a preferred embodiment of the disclosed device and that various changes and modifications may be made in the invention without departing from the spirit and scope thereof.

What is claimed is:

1. An all-around type ground reinforcing and consolidating method comprising;

an excavating step for forming an excavated space in the soil or ground by using a dual excavating rod composed of an outer excavating member and an inner excavating member which is movably arranged in the outer excavating member;

a retracting step for retracting the inner excavating member from the outer excavating member, whereby the outer excavating member is remained in the excavated space;

a check step for checking the excavated space by inserting a light member containing a battery into the excavated space;

an inserting step for inserting an injection rod into the outer excavating member;

a pressure adjusting step for adjusting the pressure in the excavated space; and an injecting step for infecting a hardening material into the excavated space while the outer excavating member and the injection rod are retracted from the excavated space, whereby the predetermined area can be consolidated.

2. The method set forth in claim 1, wherein said excavating step is carried out by using said outer excavating member and said inner excavating member slidably inserted in said outer excavating member which can be independently rotated in the same or counter direction.

3. The method set forth in claim 1, wherein said pressure adjusting step includes a first pressure adjusting step for adjusting the injection pressure of the hardening material, a second pressure adjusting step for adjusting the discharging pressure to discharge slime from the excavated space through the injection rod, and a third pressure adjusting step for adjusting the pressure in the excavated space by an elastic member in combination with the first pressure adjusting step.

4. The method set forth in claim 1, wherein said injection step includes a first injection step for injecting the hardening material, and a second injection step for injecting a hardening control agent after the injection of the hardening material.

5. An all-around type apparatus for reinforcing and consolidating a predetermined area in the soil or ground, comprising;

a dual excavating rod for forming an excavated space in the predetermined area, which includes an outer excavating member whose top end is provided with a bit, and an inner excavating member whose top end is provided with a bit, said inner excavating member being slidably and rotatably arranged in said outer excavating member;

an injection rod which includes a pressure sensor for detecting the pressure in the excavated space, a pressure adjustable member elastically expandable for adjusting the pressure in the excavated space, a discharging opening for discharging the slime and mud from the excavated space, and a plurality of injection nozzles including a first nozzle for injecting hardening control agent, a second nozzle for injecting hardening material, and a third nozzle for injecting pressurized air or water; and a drive unit for selectively driving said dual excavating rod and said injection rod linearly and revolvingly.

6. The apparatus as set forth in claim 5, wherein said drive unit includes a first drive means and a second drive means which are independently moved, and connected to said outer excavating member and said inner excavating member, respectively, so that said outer excavating member and said inner excavating member are revolved in the same or counter direction.

7. The apparatus as set forth in claim 6, wherein said outer excavating member and said inner excavating member are connected to said drive unit through connection rods, respectively.

8. The apparatus as set forth in claim 6, wherein said injection rod is mechanically connected to said second drive means of said drive unit after said inner excavating member is removed from said outer excavating member.

9. The apparatus as set forth in claim 5, wherein said pressure adjustable member is located between said second injection nozzle and said discharging opening, and expanded by pneumatic pressure.

10. The apparatus as set forth in claim 5, wherein said injection rod includes a plurality of pipes through which the hardening material, the pressurized air or water, and the hardening control agent are fed to said injection nozzles; the pneumatic pressure is fed to said pressure adjustable member; and the slime is fed from the discharging opening to the outside of the excavated space.

11. The apparatus as set forth in claim 10, wherein said connection rod includes a plurality of pipes corresponding to said pipes in said injection rod.

12. The apparatus as set forth in claim 5, wherein said second nozzle for injecting the hardening material is surrounded with said third nozzle for injecting the pressurized air or water.

13. The apparatus as set forth in claim 5, wherein said first injection nozzle for injecting the hardening control agent is positioned near the front end of said injection rod.

14. The apparatus as set forth in claim 5, wherein said discharging opening is positioned in the opposite side with respect to said second injection nozzle.

15. The apparatus as set forth in claim 12, wherein said second injection nozzle is provided with a cover which is lidably moved between close and open positions.

16. The apparatus as set forth in claim 13, wherein said first injection nozzle is provided with a cover which is slidably moved between close and open positions.

17. The apparatus as set forth in claim 14, wherein said discharging opening is provided with a cover which is slidably moved between close and open positions.

18. The apparatus as set forth in claim 15, wherein said injection rod further includes at least one of batteries for actuating said covers, and activating said pressure sensor.

19. The apparatus as set forth in claim 5, wherein said injection rod is provided at the forward end with an excavating bit.

20. The apparatus as set forth in claim 14, wherein said discharging opening includes a jet nozzle for generating sucking pressure to suck the slime into said opening.

21. The apparatus as set forth in claim 20, wherein the sucking pressure generated by said jet nozzle is controlled in response to the pressure in the excavated space detected by said pressure sensor.

* * * * *